US006809428B1

(12) United States Patent
Blackburn et al.

(10) Patent No.: US 6,809,428 B1
(45) Date of Patent: Oct. 26, 2004

(54) OVERHEAT PROTECTION OF AN ELECTRICAL COMPONENT OF AN I.C. ENGINE

(75) Inventors: Scott Evart Blackburn, Temperance, MI (US); Eric Keith Manning, Toledo, OH (US)

(73) Assignee: Dana Corporation, Toledo, OH (US)

( * ) Notice: Subject to any disclaimer, the term of this patent is extended or adjusted under 35 U.S.C. 154(b) by 64 days.

(21) Appl. No.: 10/176,049

(22) Filed: Jun. 21, 2002

(51) Int. Cl.[7] ..... F02N 11/08; F02N 11/04

(52) U.S. Cl. ..... 290/37 R; 290/36 R; 290/37 A

(58) Field of Search ..... 290/7, 36 R, 37 A, 290/37 R

(56) References Cited

U.S. PATENT DOCUMENTS

| | | | | | |
|---|---|---|---|---|---|
| 3,102,961 | A | * | 9/1963 | Kuehn, III | 290/37 R |
| 3,569,724 | A | * | 3/1971 | Kuehn, III | 290/37 R |
| 3,893,432 | A | * | 7/1975 | Krupp et al. | 123/486 |
| 3,923,016 | A | * | 12/1975 | Hoshi | 123/694 |
| 3,940,679 | A | * | 2/1976 | Brandwein et al. | 320/134 |
| 3,967,169 | A | | 6/1976 | Ellenberger | 361/106 |
| 4,021,718 | A | * | 5/1977 | Konrad | 340/636.16 |
| 4,028,616 | A | * | 6/1977 | Stevens | 324/433 |
| 4,065,712 | A | * | 12/1977 | Godard et al. | 320/144 |
| 4,116,169 | A | * | 9/1978 | Krupp et al. | 123/486 |
| 4,153,867 | A | * | 5/1979 | Jungfer et al. | 324/436 |
| 4,170,969 | A | * | 10/1979 | Asano | 123/680 |
| 4,194,146 | A | * | 3/1980 | Patry et al. | 320/136 |
| 4,209,816 | A | * | 6/1980 | Hansen | 361/23 |
| 4,209,833 | A | * | 6/1980 | Krupp et al. | 700/306 |
| 4,239,022 | A | * | 12/1980 | Drews et al. | 123/491 |
| 4,380,725 | A | | 4/1983 | Sherman | 320/150 |
| 4,470,003 | A | | 9/1984 | Mitchell | 322/23 |
| 4,494,162 | A | | 1/1985 | Eyler | 361/29 |
| 4,655,181 | A | * | 4/1987 | Ohtaki et al. | 123/686 |
| 4,858,585 | A | * | 8/1989 | Remmers | 123/335 |
| 5,198,744 | A | | 3/1993 | Kohl et al. | 322/33 |
| 5,298,852 | A | | 3/1994 | Meyer | 322/29 |
| 5,349,931 | A | | 9/1994 | Gottlieb et al. | 123/179.2 |
| 5,397,991 | A | * | 3/1995 | Rogers | 320/125 |
| 5,430,362 | A | * | 7/1995 | Carr et al. | 318/779 |
| 5,548,202 | A | | 8/1996 | Schramm et al. | 322/33 |
| 5,594,322 | A | * | 1/1997 | Rozman et al. | 322/10 |
| 5,623,197 | A | | 4/1997 | Roseman et al. | 320/134 |
| 5,929,609 | A | * | 7/1999 | Joy et al. | 322/25 |
| 6,122,153 | A | | 9/2000 | Becker | 361/25 |
| 6,137,247 | A | * | 10/2000 | Maehara et al. | 318/140 |
| 6,163,135 | A | | 12/2000 | Nakayama et al. | 320/150 |
| 6,222,349 | B1 | | 4/2001 | LeRow et al. | 322/34 |
| 6,232,748 | B1 | | 5/2001 | Kinoshita | 320/132 |
| 6,304,056 | B1 | * | 10/2001 | Gale et al. | 320/104 |
| 6,365,983 | B1 | * | 4/2002 | Masberg et al. | 290/40 C |
| 6,382,163 | B1 | * | 5/2002 | Murray et al. | 123/192.1 |
| 6,586,914 | B2 | * | 7/2003 | Garrigan et al. | 322/28 |
| 6,633,153 | B1 | * | 10/2003 | Blackburn | 320/132 |
| 6,700,212 | B2 | * | 3/2004 | Ackermann et al. | 290/36 R |

* cited by examiner

*Primary Examiner*—Nicholas Ponomarenko
*Assistant Examiner*—Pedro J. Cuevas
(74) *Attorney, Agent, or Firm*—Liniak, Berenato & Twhite

(57) ABSTRACT

A system and method for protecting a component of an I.C. engine system by controlling a starter/alternator in response to the component's temperature. The system describes a method of comparing the temperature of the component to a predetermined threshold temperature and, if the temperature exceeds the threshold, disabling the starter/alternator. According to the present invention the temperature of the vehicle battery, starter/alternator motor and starter/alternator inverter may be protected. The starter/alternator is controlled/disabled according to mode of operation.

16 Claims, 3 Drawing Sheets

OVERHEAT PROTECTION OF AN ELECTRICAL COMPONENT OF AN I.C. ENGINE

BACKGROUND OF THE INVENTION

1. Field of the Invention

The invention relates to the field of automotive electrical systems. Specifically, the invention is directed to a system and method for protecting a component of an I.C. engine system by controlling a starter/alternator in response to the component's temperature.

2. Description of the Related Art

A recent trend in automotive electrical systems is the combining of the formerly separately functioning and operating starter and alternator/generator components. As automobiles become more electronics intensive, in terms of electronic accessories and sophistication of control systems, the need becomes greater for increased electrical supply. As a result, the alternator has become physically larger and more powerful as automotive electrical needs have increased.

In addition, the need for increasing operating efficiencies from I.C. engines mandates a powerful and frequently operated starter motor to resume I.C. engine operation on short demand cycles. And, while these separate trends have been in place, a third element always present in automotive design is packaging efficiency in terms of underhood space. As these trends have progressed, a commonly proposed strategy is to combine the starter and alternator/generator into a single underhood element. In this regard, the starter function of the starter/alternator can be quite powerful vis-à-vis the I.C. engine being started inasmuch as the I.C. engine is required to achieve self-sustaining operation within ½ to 1 second of starter initiation and require significant demand of the battery. Furthermore, because of the increased demand of vehicle electrical systems, the capacity of the alternator is large and may generate substantial current during generation mode. In the event of system or component malfunction, or other unforeseen condition, a component can be caused to overheat while operating in either the starting mode or generation mode.

SUMMARY OF THE INVENTION

The present invention is directed to solving at least one of the potential problems associated with the trend towards combined starter and generator/alternator functions and short demand cycle I.C. engine operation. Specifically, the present invention is directed to a system and method for protecting a component of an I.C. engine system by controlling a starter/alternator in response to the component's temperature. The system describes a method of comparing the temperature of the component to a predetermined threshold temperature and, if the temperature exceeds the threshold, disabling the starter/alternator. According to the present invention such components may include, but not be limited to, the vehicle's battery, starter/alternator motor, and starter/alternator inverter. The starter/alternator is controlled/disabled according to mode of operation.

DETAILED DESCRIPTION OF THE PREFERRED EMBODIMENT

Figure 1:
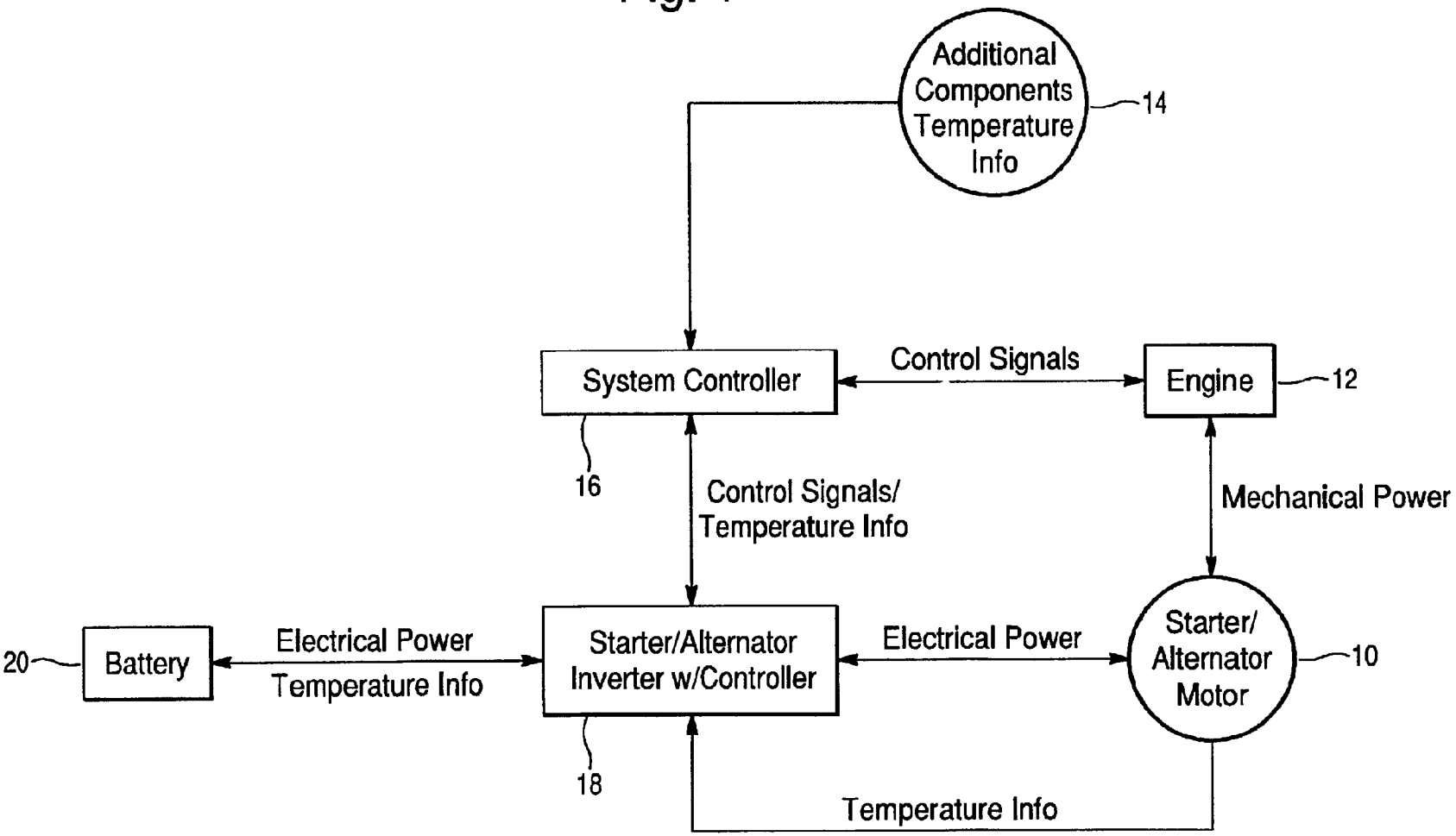
FIG. 1 shows a block diagram embodiment of the necessary sensors and hardware to accomplish the present invention.

Referring to FIG. 1, the invention is directed to a method of controlling a starter/alternator 10 in an I.C. engine installation and is specifically directed to disabling the starter/alternator when a temperature of a component exceeds a predetermined threshold. The starter/alternator 10 may be an integrated unit, i.e., in combination with the crankshaft mounted flywheel or balancer, or a separate belt, chain, or gear driven/driving unit. In any configuration, the unit 10 is used to start the I.C. engine according to a predetermined instruction, i.e., operator or accessory load demand, and is used to provide electrical power for either immediate consumption or for storage, i.e., battery charging. The starter/alternator 10 is directly coupled for rotation with the engine 12. The engine is equipped with various sensors for determining rotational speed, temperature, crank position, cam position, etc., and provides this information to a system controller 16. The controller 16 likewise receives and transmits operational information to and from the starter/alternator inverter 18 having an associated controller to selectively choose either the starter or alternator function for the starter/alternator 10 and to control the alternator during engine operation. A battery 20 is also a part of the system to provide electrical power to activate the starter/alternator when the starter function is selected and to be regenerated during a generation mode of the starter alternator. The battery 20 is equipped with a temperature sensor (not shown). The temperature sensor may either provide sensed information directly to the system controller 16 or through the inverter controller 18 as shown. Temperature sensors can also be incorporated into the motor 10 and/or inverter components of the starter alternator assembly. It is to be understood that sensing of temperature of these components and providing the sensed temperature to a central controller is well within the knowledge of one of ordinary skill in the art and thus the details need not be explained. Other electrical components may also be sensed as generically indicated by reference number 14.

In the event the temperature of a component (battery, inverter, motor, or other component) reached a predetermined threshold, the system controller 16 and/or inverter controller 18 disables the starter/alternator. Increased temperature can come from many factors such as a malfunction or other unforeseen condition such a mechanical or electrical overload. Regardless, however, if the temperature of the component sensed reaches the threshold temperature the starter/alternator is disabled. Depending upon the mode of operation of the starter/alternator, the disabling and re-enabling sequence can be changed.

Figure 2:
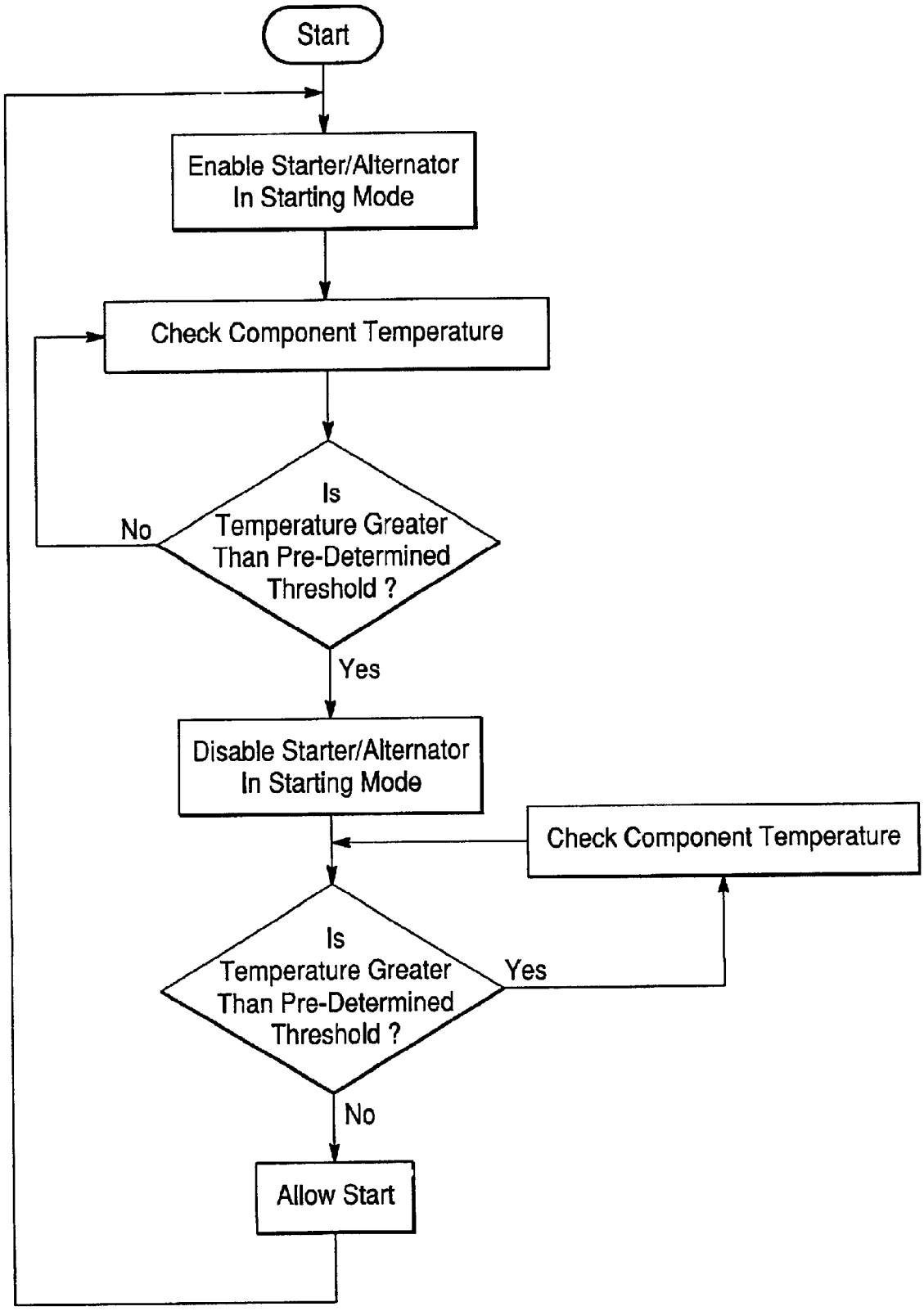
FIG. 2 shows a flow chart of decision making for the method used by the system controller to determine a component overheat condition during starter/alternator starting mode.

FIG. 2 represents a block diagram for the logic sequence of the system controller 16 and/or inverter controller 18 in using the method of the present invention in the starting mode. When attempting to start the I.C. engine, the component (battery, inverter, motor, or other electrical component) temperature is sensed. If the temperature sensed reached a predetermined threshold during a starting sequence, the starting function is disabled. The temperature is continuously monitored until the component falls below the threshold. Once the temperature falls below the threshold, the starting sequence is allowed to continue. The starting sequence may also be suspended for a predetermined period of time (i.e., 30 seconds) after detection of an excessive temperature. A start sequence is initiated for any predetermined reason, i.e, battery charging, accessory operation, vehicle acceleration, etc. The starter/alternator is placed into start mode. The components temperatures are sensed and a comparison is made to determine if the detected temperatures have exceeded a predetermined threshold temperature in a start sequence. If the temperature is lower, the starter/alternator can continue cycling to start the I.C. engine. If the detected temperature is higher, then the starter/alternator is disabled. The starter/alternator may also be disabled in starting mode for a predetermined period of time sufficient to shed destructive heat in the system and to regain acceptable temperature of the components to be protected.

The starter/alternator may be disabled in any known fashion and is preferably disabled simply by preventing a current delivery to the starter/alternator to prevent the starter motor from cranking the engine or otherwise operating during overheat conditions.

Figure 3:
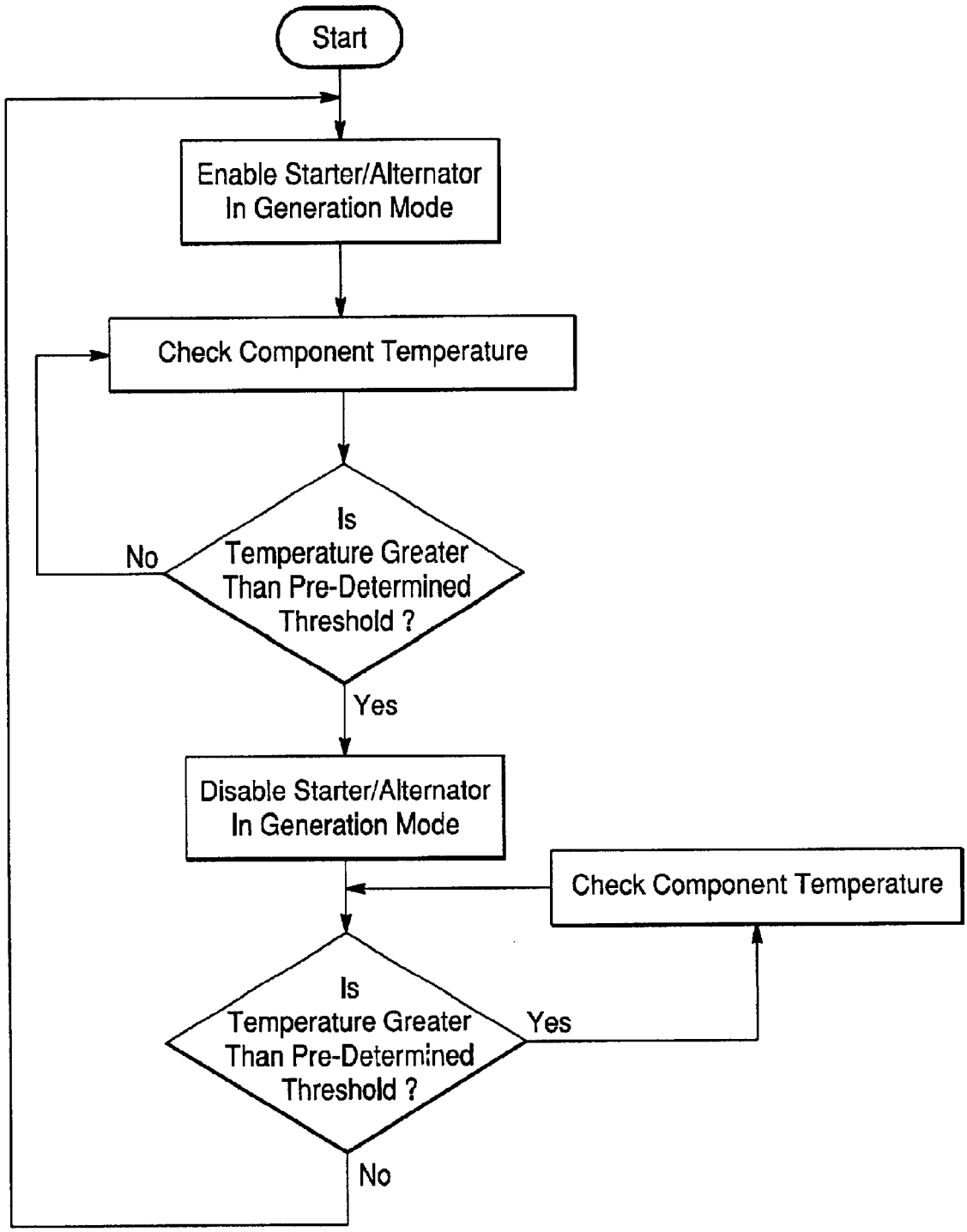
FIG. 3 shows a flow chart of decision making for the method used by the system controller to determine a component overheat condition during starter/alternator generating mode.

FIG. 3 represents a block diagram for the logic sequence of the system controller 16 and/or inverter controller 18 in using the method of the present invention in the generation mode. The sequence is very similar to that depicted in FIG. 2 with the exception that the starter/alternator is operating in generation mode during engine operation. When in a different mode of operation the specific method of disabling the starter/alternator may differ. As in the starting mode, disabling may be accomplished by limiting a current to the starter/alternator during generation mode. However, because of the different operational characteristics associated with the starting and generating modes, different current isolation techniques may be employed. It is to be understood that disabling the starter/motor from generating electrical power from commands from the system controller 16, inverter 18 and/or other controller, is well within the knowledge of one of ordinary skill in the starter/alternator art. Any method of disabling the starter/alternator may be employed. However, it is preferred to isolate current.

The acceptable threshold temperatures are dependent on the component to be protected. For example, the threshold for the vehicle battery may be (sixty) 60° C. whereas the threshold temperatures for the starter/alternator inverter and motor components may be (one hundred) 100° C. The threshold temperature must be picked to allow normal operation but provide protection for operation beyond its design capacity before the component is damaged. The system controller 16 and/or inverter controller 18 is simply programmed with an algorithm to compare the sensed temperature with a stored threshold temperature and to control/disable the starter/alternator accordingly as previously described.

The foregoing method will improve the performance and overall reliability of the starter/alternator system by controlling and limiting excessive temperature and overheat conditions of the electrical components. In accordance with the method, the starter/alternator system is preserved from destructive excessive operation. It is also noted that the threshold temperature could change for different ambient conditions when appropriate. In such case, an ambient temperature sensor may be incorporated into the present system for conditionally setting the threshold temperatures of the components. Regardless of design parameters, however, the applied method would follow the necessary detecting and comparison steps according to the predetermined criteria specified for the starter/alternator system being used.

It is to be understood that the particular nature of a starter/alternator system is significantly different from conventional systems having a conventional starter motor separate from the alternator. It has been shown that present invention of protecting electrical components from excessive temperature is particularly beneficial in the starter/alternator environment and is efficiently controlled simply by disabling the starter/alternator in response to excessive temperature. Thus, while the present algorithm may be employed in conventional systems, the additional benefits associated with a starter/alternator arrangement, heretofore not recognized in the prior art, will be appreciated.

While the foregoing invention has been shown and described with reference to preferred embodiments, it will be understood by those possessing skill in the art that various changes and modifications may be made without departing from the spirit and scope of the invention. For example, while the present invention has been shown and described for operation with a starter/alternator in either a start and/or generation mode, the present invention may also be employed to protect a component by disabling the starter/alternator in an engine assist mode or a motoring mode where the starter/alternator is employed to be decoupled with the crankshaft of the engine and used to drive accessory components. Furthermore, the present invention has been embodied in a starter/alternator system utilizing a switched reluctance (SR) motor. However, it is to be understood that a starter/alternator with any microprocessor-controlled motor may be employed. Lastly, while three specific components (battery, inverter and motor) have been shown in a single system, one, all, or any combination of such elements may be sensed and/or protected by the method of the present invention. The descriptions of the invention herein are not to be considered limiting except as to the claims that follow.

What is claimed is:

1. A method of controlling a starter/alternator in an I.C. engine, comprising the steps of:

detecting a temperature of a first component of said I.C. engine and obtaining a first detected temperature;

comparing said first detected temperature with a predetermined acceptable temperature; and, disabling said starter/alternator when said detected temperature exceeds said predetermined acceptable temperature.

2. The method according to claim 1, wherein said step of detecting a temperature of a first component of said I.C. engine includes detecting a temperature of a battery.

3. The method according to claim 2, wherein said step of disabling said starter/alternator includes disabling the starter/alternator to prevent generation of electrical power by isolating a current to said starter/alternator during a generation mode of operation.

4. The method according to claim 2, wherein said step of disabling said starter/alternator includes disabling the starter/alternator to prevent cranking of said I.C. engine by isolating a current to said starter/alternator during a starting mode of operation.

5. The method according to claim 3, wherein said threshold temperature is about 60° C.

6. The method according to claim 4, wherein said threshold temperature is about 60° C.

7. The method according to claim 1, wherein said step of detecting the temperature of the first component of said I.C. engine includes detecting a temperature of a motor component of said starter/alternator.

8. The method according to claim 7, wherein said step of disabling said starter/alternator includes disabling the starter/alternator to prevent generation of electrical power by isolating a current to said starter/alternator during a generation mode of operation.

9. The method according to claim 7, wherein said step of disabling said starter/alternator includes disabling the starter/alternator to prevent cranking of said I.C. engine by isolating a current to said starter/alternator during a starting mode of operation.

10. The method according to claim 8, wherein said threshold temperature is about 100° C.

11. The method according to claim 9, wherein said threshold temperature is about 100° C.

12. The method according to claim 1, wherein said step of detecting a temperature of a first component of said I.C. engine includes detecting a temperature of an inverter component of said starter/alternator.

13. The method according to claim 12, wherein said step of disabling said starter/alternator includes disabling the starter/alternator to prevent generation of electrical power by isolating a current to said starter/alternator during a generation mode of operation.

14. The method according to claim 12, wherein said step of disabling said starter/alternator includes disabling the starter/alternator to prevent cranking of said I.C. engine by isolating a current to said starter/alternator during a starting mode of operation.

15. The method according to claim 13, wherein said threshold temperature is about 100° C.

16. The method according to claim 14, wherein said threshold temperature is about 100° C.

* * * * *